US005447537A

United States Patent [19]

Choi

[11] Patent Number: 5,447,537

[45] Date of Patent: Sep. 5, 1995

[54] COTTON FABRICS WITH IMPROVED STRENGTH RETENTION

[75] Inventor: Hyung-Min Choi, Baton Rouge, La.

[73] Assignee: Board of Supervisors of Louisiana State University and Agricultural and Mechanical College, Baton Rouge, La.

[21] Appl. No.: 863,876

[22] Filed: Apr. 6, 1992

[51] Int. Cl.[6] ..... D06M 14/04; D06M 13/192

[52] U.S. Cl. ..... 8/115.6; 8/116.1; 8/120; 8/127.1; 8/115.7

[58] Field of Search ..... 8/120, 127.1, 116.1, 8/115.6, 115.5, 115.7

[56] References Cited

U.S. PATENT DOCUMENTS

| | | | |
|---|---|---|---|
| 3,575,960 | 4/1971 | Tesoro et al. | 8/120 |
| 3,995,998 | 12/1976 | Rowland et al. | 8/115.6 |
| 4,820,307 | 4/1989 | Welch et al. | 8/120 |
| 4,936,865 | 6/1990 | Welch et al. | 8/120 |
| 4,975,209 | 12/1990 | Welch et al. | 252/8.6 |
| 5,190,563 | 3/1993 | Herron | 8/120 |

*Primary Examiner*—John Niebling
*Assistant Examiner*—Edna Wong
*Attorney, Agent, or Firm*—John H. Runnels

[57] ABSTRACT

A non-formaldehyde polymerization-crosslinking treatment for cotton or other cellulose-containing fabrics resulting in a fabric with good durable press, wrinkle recovery, and other mechanical properties. Unsaturated monomers having two or more carboxyl groups are used in a polymerization-crosslinking treatment at a pH below about 3. The preferred system uses maleic acid and itaconic acid comonomers, potassium persulfate as a free radical initiator, and sodium hypophosphite as an esterification catalyst. A high quality durable press cotton fabric may be produced which does not release formaldehyde during processing, storage, or consumer use.

11 Claims, No Drawings

COTTON FABRICS WITH IMPROVED STRENGTH RETENTION

This invention pertains to improved cotton or other cellulose-containing fabrics, particularly to cotton fabrics treated with a non-formaldehyde-generating polymerization-crosslinking treatment.

Two common problems in the durable press finishing of cotton fabrics with conventional resins, such as dimethyloldihydroxyethyleneurea (DMDHEU), are: (1) the release of formaldehyde, a toxic compound, during processing, storage, and consumer use; and (2) the loss of mechanical properties of the treated fabrics.

Polymerization-crosslinking (PC) treatments have been tested as a way to alleviate the loss of strength and abrasion resistance in durable press finished cotton fabrics and fibers. Better retention of mechanical properties can be obtained with the deconvolution of cotton fibers through the deposition of polymerizing resins within the interior of wet, swollen fibers, and the subsequent formation of long, flexible crosslinks between cellulose molecules via the functional groups of the resins. However, most prior PC treatments have employed formaldehyde-based-monomers such as N-methylolacrylamide, which can later cause the fabric to release formaldehyde. The release of formaldehyde can cause health problems for workers who prepare or process the fabrics, and for consumers using or wearing the fabrics. Relatively little work has been done with alternative PC systems that do not generate or release formaldehdye.

Welch et al., U.S. Pat. Nos. 4,975,209; 4,936,865; and 4,820,307 disclose the reaction of certain polycarboxylic acids with fibrous cellulosic materials to esterify and crosslink the cellulose with the polycarboxylic acid. Polymerization of the crosslinking agents is not mentioned. Maleic acid, itaconic acid, citraconic acid, and trans-aconitic acid are included in a general listing of several possible polycarboxylic acids which might be used in the process. Alkali metal hypophosphites, including sodium hypophosphite, are disclosed as curing catalysts.

Rowland et al., U.S. Pat. No. 3,995,998 discloses that certain carboxyl-containing vinyl monomers can be deposited, polymerized, and fixed on various types of fibers, including cotton, by a process wherein an aqueous solution of the vinyl monomers is brought to a pH above 3.6, combined with a free-radical initiator with or without additional comonomers, applied to a fibrous substrate, and subjected to curing conditions to polymerize the vinyl monomer. The primary monomers of the disclosure include a listing of several carboxyl-containing vinyl compounds, including itaconic and maleic acid. Several potential comonomers are also listed. Alkali metal persulfates are disclosed as initiators. A pH above 3.6 was required as improving the conversion of monomers to polymers.

The present invention concerns a novel PC treatment of cotton or other cellulose-containing fabrics. The novel treatment produces fabrics with high durable press ratings and wrinkle recovery angles, but does not release formaldehyde during processing, storage, or consumer use. The invention employs the polymerization and crosslinking with cellulose of unsaturated monomers having at least two carboxyl groups, at a pH below about 3. A preferred treatment uses maleic acid and itaconic acid as comonomers, potassium persulfate as a free radical initiator, and sodium hypophosphite as an esterification catalyst. Fabrics treated with this novel PC system can have much higher retention of mechanical properties, and a similar whiteness index when compared with fabrics treated by the more conventional DMDHEU. The increase in tear strength retention (warp and fill) was considerable. The Stoll flex abrasion resistances of the treated fabrics were in most cases higher than those of an untreated control, while a DMDHEU-treated sample showed only 18% of the abrasion resistance of the control. Stiffness of the treated fabric decreased.

Desized, scoured, and bleached 100% cotton twill fabric, 266 g/m$^2$, supplied by Cotton, Inc., was used throughout this study. Maleic acid, itaconic acid, methacrylic acid, 2-hydroxyethyl methacrylate, N-vinyl-2-pyrrolidone, and poly(N-vinyl-2-pyrrolidone) with a molecular weight of 40,000 were purchased from Aldrich Chemical Company. Potassium persulfate ($K_2S_2O_8$), a free radical initiator, and various catalysts for esterification reactions were all obtained from readily available, commercial sources. DMDHEU (Aerotex 900, 48% solid content) and a polyethylene emulsion softener (Cyanalube TSI) were supplied by American Cyanamid, Inc. Triton X-100 was used as a wetting agent. All chemicals used were reagent grade, and were used without further purification.

Pre-weighed cotton fabric samples with dimensions of 58.4 cm $\times$33.0 cm were impregnated for five minutes in an aqueous treating bath containing monomer(s), polymerization initiator, esterification catalyst, fabric softener, and wetting agent. In all cases, the concentrations of free radical initiator, softener, and Triton X-100 were 1.5% of weight of monomers, 1% of weight of bath, and 0.1% of weight of bath, respectively. To increase the solubility of the solid components in water, the bath was heated slightly to 30°$\pm$2° C., where it was maintained during impregnation of the fabric. The fabric was then passed through a laboratory padder at a pressure of $2.07\times10^5$Pa (30 psi). The impregnation and padding steps were repeated to give a wet-pick-up (increased weight) of the wetted fabric between 80–95% of the weight of the fabric. The sample was mounted on a pin frame, dried in an oven for 10 minutes at 100° C., and cured for 2 minutes at 180° C., unless otherwise specified.

For comparison purposes, DMDHEU was applied as a 12% aqueous solution containing 1.5% $Zn(NO_3)_2.6H_2O$, 1% softener, and 0.1% Triton X-100. The fabric was dried for 5 minutes at 100° C., and then cured for 3 minutes at 165° C.

The treated fabrics were weighed after conditioning in a standard atmosphere, and weight pick-up was determined through standard means known in the art. Whiteness index (WI) was determined before washing according to ASTM E313-67, using the Colorgard System 1000 Colorimeter from Pacific Scientific Company. Laundering was carries out according to AATCC 124-1982 at machine wash condition II (49°$\pm$3° C.) with AATCC standard detergent 124, followed by tumble drying. Add-on and fixation were determined through means known in the art. The standard methods used for evaluation of performance properties of the treated fabric were as follows: durable press rating by AATCC 124-1982, conditioned wrinkle recovery angle by ASTM D-1296-67, bending stiffness by ASTM D-1388-55, Elmendorf tear strength by ASTM D-1424-82, breaking strength by ASTM-1682-64 (strip method), Stoll flex abrasion resistance by ASTM-1175-55T. In testing Stoll flex abrasion resistance, the number of cycles required to break was recorded. With the exception of wrinkle recovery angle and tear strength, all tests were made in the warp direction.

Total ester content in the treated fabric was determined by the modified Eberstadt method, and unesterified free carboxyl groups were measured with a direct titration of the fabric. C.I. Basic Blue 9 and Basic Red 1 were used to dye the control and treated fabrics. CIE color differences (ΔE) were measured against an undyed control sample according to AATCC 153-1978, using the above Colorimeter. A Perkin Elmer FTIR 1760X Spectrometer was used to perform infrared analysis with the standard potassium bromide pellet technique. The cupriethylenediamine hydroxide (cuene) solubility technique known in the art was used to measure the extent of crosslinking in the treated samples.

Various copolymer systems of maleic acid with other vinyl monomers such as methacrylic acid, hydroxyethyl methacrylate, and N-vinyl-2-pyrrolidone were used to treat samples of cotton fabric. A pre-formed polymer, poly(N-vinyl-2-pyrrolidone), was also used to enhance polymerization of maleic acid by forming a polymer complex through hydrogen bonding. In order to compare homo- and co-polymer systems of maleic acid, a 12% maleic acid system with no comonomer was applied to the fabric as a control run. As shown in Table I, the fabric treated with 12% maleic acid showed some improvement in durable press properties, but retention of mechanical strength was generally lower than that of the fabrics treated with comonomer systems.

TABLE I

Experimental results for various comonomer systems.[a]

| Monomers (molar ratio) | Pick-up[c] % | Add-on[d] % | Fixation[c] % | Durable Press Rating | Wrinkle Recovery Angle, degree (w + f) | Tear strength retention, % w | Tear strength retention, % f | Breaking strength retention % | Stoll flex abrasion retention % | Bending length cm |
|---|---|---|---|---|---|---|---|---|---|---|
| Untreated | — | — | — | 1.5 | 171 | 100 | 100 | 100 | 100 | 3.7 |
| DMDHEU-treated | — | 4.0 | — | 4.5 | 278 | 55 | 59 | 45 | 18 | 3.0 |
| Maleic acid | 12.3 | 9.1 | 74 | 3.5 | 219 | 67 | 73 | 56 | 99 | 2.9 |
| Maleic acid/N-vinyl-2-pyrrofidone (2:1) | 10.5 | 7.7 | 73 | 3.8 | 229 | 73 | 86 | 63 | 156 | 2.7 |
| Maleic acid/poly(N-vinyl-2-pyrrolidone (2:1) | 11.3 | 7.5 | 66 | 4.0 | 240 | 103 | 96 | 58 | 229 | 2.4 |
| Maleic acid/2-hydroxyethyl methacrylate (2:1) | 9.5 | 8.6 | 91 | 3.8 | 233 | 86 | 91 | 61 | 241 | 2.5 |
| Maleic acid/Methacrylic acid (3:1) | 12.9 | 8.2 | 64 | 3.5 | 229 | 75 | 91 | 65 | 150 | 2.8 |
| Maleic acid/Methacrylic acid (2:1) | 11.7 | 7.1 | 61 | 3.7 | 241 | 93 | 90 | 90 | 188 | 2.9 |
| Maleic acid/Methacrylic acid (1:1) | 11.9 | 5.3 | 45 | 3.0 | 207 | 95 | 89 | 67 | 169 | 3.1 |
| Maleic acid/Methacrylic acid (1:2) | 12.1 | 3.9 | 32 | 3.0 | 203 | 80 | 71 | 69 | 138 | 3.2 |
| Maleic acid/Itaconic acid (2:1) | 12.7 | 9.6 | 76 | 4.0 | 254 | 78 | 82 | 56 | 196 | 2.5 |
| Maleic acid/Itacortic acid (1:1) | 17.4 | 11.6 | 67 | 4.4 | 268 | 76 | 90 | 49 | 214 | 2.7 |
| Maleic acid/Itaconic acid (1:2) | 13.8 | 10.8 | 78 | 4.0 | 258 | 68 | 87 | 67 | 131 | 2.7 |
| Maleic acid/Itaconic acid/Methacrylic acid(1:2:1) | 13.5 | 9.5 | 70 | 3.7 | 251 | 87 | 87 | 62 | 188 | 2.8 |

[a]Treating bath-12% monomers, 1.5% owm $K_2S_2O$, $NaH_2PO_2.H_2O$ (1:1 molar ratio between monomer and catalyst), 1% softener, and 0.1% Triton X-100. Dry-100° C./10 minutes. Cure-180° C./2 minutes. Wash and tumble dry.
[b]Treating bath-12% DMDHEU, 1.5% $Zn(NO_3)_2.6H_2O$, 1% softener, and 0.1% Triton X-100. Dry-100° C./5 minutes. Cure-165° C./3 minutes. Wash and tumble dry.
[c]Pick-up(%) = {(weight after treatment - initial weight)/initial weight} × 100.
[d]Add-on(%) = {(weight after treatment and washing-initial weight)/initial weight} × 100.
[e]Fixation(%) = (% add-on/% pick-up) × 100.

Table I also shows the polymerization efficiency of each system, and the performance properties of the treated cotton fabrics. The degree of pick-up is a measure of the amount of polymer formed, together with other additives present in the fiber before washing. Most unbound monomers, polymers, and other additives were subject to being washed out, as indicated by the add-on and fixation columns. The system of maleic acid and hydroxyethyl methacrylate gave the highest fixation, suggesting a high efficiency of copolymerization by these monomers. However, this system did not crosslink sufficiently to give a satisfactory durable press rating and wrinkle recovery angle. On the other hand, tearing strength and Stoll flex abrasion resistance of the treated fabric was significantly increased. Other systems such as maleic acid and N-vinyl-2-pyrrolidone, and maleic acid and poly(N-vinyl-2-pyrrolidone) showed the same trends.

It was interesting to note that in the systems of maleic acid and methacrylic acid at different molar ratios, the add-on and fixation decreased as the proportion of methacrylic acid increased. This result could be due to the formation of homopolymer in methacrylic acid-rich systems. Because the formation of six-membered anhydride rings was the only apparent mechanism for the fixation of methacrylic acid homopolymer to a cellulose molecule, esterification through these anhydride rings was presumably not as effective as the five-membered anhydride ring formation in maleic acid or itaconic acid at the conditions employed. This hypothesis was supported by the results obtained in the treatment of cotton fabric with methacrylic acid alone, which did not produce sufficient add-on, durable press rating, or wrinkle recovery angle.

Maleic acid and itaconic acid are both inexpensive, unsaturated, dicarboxylic monomers capable of undergoing an esterification reaction with cotton cellulose. Both maleic acid and itaconic acid form anhydrides at elevated temperatures. At these temperatures, possible reactions include the isomerization of maleic acid to fumaric acid (which could be catalyzed by ammonium persulfate), or the isomerization of itaconic acid to citraconic acid and mesaconic acid. In any case, anhydride rings could be formed within a maleic acid or itaconic acid molecule, or with neighboring carboxyl groups in other molecules.

The spectrum of the 1:1 maleic acid/itaconic acid-treated samples showed a carbonyl stretching band at 1700–1750 $cm^{-1}$, typical of a carboxylic ester. In addition, the presence of unesterified free carboxyl groups was shown by carboxylate absorption at 1586 $cm^{-1}$. As expected, the DMDHEU-treated sample did not show carboxylate absorption, although it exhibited a peak for carbonyl stretching at 1717 $cm^{-1}$.

Monomers suitable for use in the present invention include other unsaturated compounds having two or more carboxyl groups. Other monomers believed to have promise, but untested as of the date of this application was filed, include citraconic acid; trans-aconitic acid; and 3-butene-1,2,3-tricarboxylic acid.

In performing the process of this invention, it is preferred that the pH be below about 2. Observations to date have shown poor performance at a pH above about 3.

PERFORMANCE PROPERTIES

The 1:1 maleic acid/itaconic acid system had a durable press rating and wrinkle recovery angle comparable with those of samples treated by DMDHEU. At similar levels of resilience, mechanical properties (except breaking strength) were better retained in the fabric treated with maleic acid and itaconic acid. Striking effects were shown in the increase of Stoll flex abrasion resistances, which were 30% to 140% higher than those for the untreated fabric. Conversely, DMDHEU-treated fabric had only 18% of the abrasion resistance of the untreated sample. Considering that the same amounts of softener were used throughout the treatments, the discrepancy in Stoll flex abrasion resistance was considerable. These results therefore suggest that the novel PC treatment of cotton fabric resulted in better retention of strength and abrasion resistances through the deconvolution of cotton fibers, and through the generation of longer, flexible crosslinks.

For most of the samples, the retention of tear strength in the fill direction was better than that in the warp direction. Cross tears often occurred for warp specimens, because of the higher strength of warp yams. The stiffness of the treated fabric decreased in most samples.

The 1:1 maleic acid/itaconic acid system is preferred. Further tests with that system are discussed below.

CATALYST EFFECTS

As listed in Table II, several catalysts were tested with the 1:1 maleic acid/itaconic acid system for the novel PC treatment of cotton fabric: sodium carbonate ($Na_2CO_3$), ammonium phosphate monobasic ($(NH_4)H_2PO_4$), sodium phosphate dibasic heptahydrate ($Na_2HPO_4.7H_2O$), sodium chloride (NaCl), sodium hypophosphite hydrate ($NaH_2PO_2.H_2O$), and sodium acetate ($NaOOCCH_3$). Other than sodium hypophosphite, these catalysts did not produce adequate increases in the durable press ratings and wrinkle recovery angles of the treated cotton fabrics. The other catalysts also caused undesirable yellowing of the treated samples. Sodium chloride had a considerable adverse effect on mechanical properties, possibly due to the generation of hydrochloric acid by the reaction of NaCl with carboxylic acid groups in the monomers. Other possible catalysts might include imidazole and its derivatives, such as 1-methylimidazole, 2-methylimidazole; or triazole and its derivatives.

TABLE II

Effect of various catalysts for Maleic acid/Itaconic acid (1:1) systems.[a]

| Catalysts (% owb) | Acid-Catalyst molar ratio | Add-on % | Durable Press rating | Wrinkle Recovery Angle degree (w + f) | Tear strength retention, % w | Tear strength retention, % f | Breaking strength retention % | Stoll flex abrasion retention % | Bending length cm | Fabric color[b] |
|---|---|---|---|---|---|---|---|---|---|---|
| 3.5% $Na_2CO_3$ | 3:1 | 3.6 | 2.5 | 201 | 106 | 111 | 61 | 323 | 2.9 | yellow |
| 5.8% $NH_4H_2PO_4$ | 2:1 | 5.0 | 3.5 | 211 | 58 | 63 | 43 | 162 | 2.7 | tan |
| 8.9% $Na_2HPO_4.7H_2O$ | 3:1 | 5.4 | 3.3 | 204 | 91 | 87 | 46 | 366 | 2.9 | sl. yellow |
| 4.2% NaCl | 1:1 | 3.3 | 2.5 | 205 | 13 | 17 | 15 | 30 | 2.5 | yellow |
| 2.9% $NaH_2PO_2.H_2O$ | 3:1 | 7.4 | 4.0 | 233 | 82 | 91 | 64 | 323 | 2.7 | off-white |
| 5.9% $NaH_2PO_2.H_2O$ | 2:1 | 7.7 | 3.5 | 242 | 93 | 86 | 73 | 269 | 3.0 | off-white |
| 8.8% $NaH_2PO_2.H_2O$ | 1:1 | 11.6 | 4.4 | 268 | 76 | 90 | 49 | 214 | 2.7 | white |
| 12% $NaH_2PO_2.H_2O$ | 1:1.33 | 10.8 | 4.4 | 256 | 79 | 90 | 57 | 226 | 2.7 | white |
| 6.0% $NaOOCCH_3$ | 1:1 | 3.7 | 3.0 | 213 | 110 | 123 | 70 | 384 | 2.7 | yellow |

[a]Treating bath-12% Maleic acid and Itaconic acid (1:1), 1.5% owm $K_2S_2O_8$, catalyst, 1% softener, and 0.1% Triton X-100. Dry-100° C./10 minutes. Cure-180° C./2 minutes. Wash and tumble dry.
[b]After one laundering.

The effect of varying the amount of sodium hypophosphite is also shown in Table II. Wrinkle recovery angle reached a maximum at about a one-to-one molar ratio of monomer to sodium hypophosphite. The amount of sodium hypophosphite also played a role in determining the color of the treated fabric. The systems containing less catalyst (less than a 1:1 molar ratio of monomers to catalyst) showed a light greenish color immediately after curing, but changed color to slightly off-white after conditioning in the standard atmosphere.

At higher sodium hypophosphite concentrations (1:1 and 1:1.33), the fabric color was consistently white.

MONOMER CONCENTRATION

Aqueous baths containing different concentrations of maleic acid and itaconic acid at the same 1:1 molar ratio were used to treat cotton fabric samples as listed in Table III. The variability in the fixation at different monomer concentrations was probably due to variation in the amounts of catalyst. Because a 1:1 monomer to catalyst molar ratio was used in all baths, more catalyst was needed in the baths at higher monomer concentrations. Therefore, the catalyst sorbed by the fabric was washed out, and consequently lower fixations were seen with higher amounts of catalyst.

TABLE III

Effects of the PC Treatment on 100% Cotton Twill (Maleic acid/Itaconic acid, 1:1).[a]

| Monomer Concentration, % owb (Curing °C./min) | Pick-up % | Add-on % | Fixation % | Durable Press rating | Wrinkle Recovery Angle degree (w + f) | Tear strength retention, % w | Tear strength retention, % f | Breaking strength retention % | Stoll flex abrasion retention % | Bending length cm | Whiteness Index[b] |
|---|---|---|---|---|---|---|---|---|---|---|---|
| 6.2% | 6.3 | 5.2 | 83 | 3.7 | 242 | 85 | 98 | 62 | 221 | 2.7 | 46.7 |
| 8.9% | 10.4 | 8.4 | 81 | 4.0 | 271 | 83 | 97 | 59 | 148 | 2.5 | 47.0 |
| 12% (160/3.5) | 15.9 | 11.4 | 72 | 4.2 | 272 | 62 | 89 | 58 | 143 | 2.5 | 44.7 |
| 12% (170/2) | 16.0 | 11.3 | 71 | 4.0 | 273 | 70 | 88 | 60 | 158 | 2.5 | 49.7 |
| 12% (180/2) | 17.4 | 11.6 | 67 | 4.4 | 268 | 76 | 90 | 49 | 214 | 2.7 | 49.0 |
| 12% (190/2) | 15.0 | 11.3 | 75 | 4.4 | 283 | 51 | 78 | 58 | 133 | 2.4 | 30.3 |
| 15.6% | 20.4 | 13.5 | 66 | 4.5 | 290 | 46 | 82 | 54 | 81 | 2.5 | 45.5 |

[a]Treating bath-monomers, 1.5% owm $K_2S_2O_8$, 8.8% $NaH_2PO_2.H_2O$, 1% softener, and 0.1% Triton X-100. Dry-100° C./10 minutes. Cure-180° C./2 minutes, unless otherwise specified.
[b]Before washing.

Except at the 6.2% monomer concentration, treatments with maleic acid and itaconic acid improved durable press rating and wrinkle recovery angle to a degree comparable to those for DMDHEU-treated fabric, but with higher retention of tear strength and Stoll flex abrasion resistance. Stiffness of the treated fabrics also decreased, and softness was enhanced. Although some degradation of the treated fabric was seen at a 15.6% monomer concentration, tear strength in the fill direction and Stoll flex abrasion resistance were still much higher than those of the DMDHEU-treated sample. The whiteness index appeared to reach a maximum at about 12% monomer concentration.

conic acid system gave good durable press rating and wrinkle resistance properties. In addition, these samples showed better retention of mechanical properties. The increases in tear strength in the fill direction, and in Stoll flex abrasion resistance relative to DMDHEU were substantial. Whiteness indices of the DMDHEU-treated and the untreated control were 48.3 and 56.3, respectively. An extended curing time (3.5 minutes) at 160° C. slightly decreased the whiteness index, while treatment at a high curing temperature (190° C.) caused a significant decrease in the whiteness index.

The PC treatment of this system still resulted in a loss in breaking strength, though the loss was less than was the case with DMDHEU. Examination with a scanning electron microscope showed a relatively clean fiber surface, and little fiber swelling. This observation suggests that the pad-dry-cure process resulted in the deposition of polymers just below the fiber surface, due to relatively low diffusion of monomers, and/or migration of monomers during the drying stage. This conclusion was supported by observations of dyeing with basic dyes. The treated fabrics showed considerable affinities towards basic dyes, as shown in Table IV. It is expected that nonconventional treatment techniques, such as wet-fixation or steam-fixation (not yet tested by the inventor), may improve the breaking strength of the treated fiber.

TABLE IV

Analyses of the treated fabric with the Maleic acid/Itaconic acid system (1:1).[a]

| Monomer Concentration, % owb (Curing °C./min) | Add-on % | Cuene solubility % | % Acetyl | —COOH content (meq/100 g sample) | ΔE Basic Red 1 | ΔE Basic Blue 9 |
|---|---|---|---|---|---|---|
| 6.2% | 5.2 | 6.4 | 0.1744 | 31.3 | — | 74.6 |
| 8.9% | 8.4 | 22.4 | 0.1946 | 55.8 | — | 74.7 |
| 12% (160/3.5) | 11.4 | — | 0.4545 | 35.8 | — | 75.0 |
| 12% (170/2) | 11.3 | — | 0.3010 | 45.1 | — | 74.9 |
| 12% (180/2) | 11.6 | 53.3 | 0.6416 | 76.1 | 81.6 | 74.5 |
| 12% (190/2) | 11.3 | — | 0.3946 | 40.6 | — | 74.8 |
| 15.6% | 13.5 | 58.0 | 0.9120 | 69.3 | — | 75.3 |
| DMDHEU-treated[b] | 4.0 | 94.5 | — | — | 62.9 | 42.2 |
| Untreated | — | 2.7 | — | 5.7 | 67.9 | 54.8 |

[a]Treating bath-monomers, 1.5% owm $K_2S_2O_8$, 8.8% $NaH_2PO_2.H_2O$, 1% softener, and 0.1% Triton X-100. Dry-100° C./10 minutes. Cure-180° C./2 minutes, unless otherwise specified.
[b]Treating bath- 12% DMDHEU, 1.5% $Zn(NO_3)_2.6H_2O$, 1% softener, and 0.1% Triton X-100. Dry-100° C./5 minutes. Cure-165° C./3 minutes.

CURING CONDITIONS

As shown in Table III, at the same monomer concentration similar fixations were seen at different curing temperatures, apparently because polymerization occurred primarily during the drying stage. At curing temperatures of 160–190° C., the 1:1 maleic acid/ita- Table IV also lists the degree of ester linkage, calculated as percent acetyl groups, and the concentration of free carboxylic acid groups in the treated fabric. Both % acetyl and —COOH content tended to increase with increased polymer add-on. However, a decrease in ester content and carboxyl content were seen with a cure temperature of 190° C. compared to that at 180° C., indicating that some decarboxylation of maleic acid and itaconic acid may have occurred during free radical polymerization. It was found that the cuene solubility technique was not suitable for measuring the extent of crosslinking. The low cuene insolubility of maleic acid-/itaconic acid-treated samples, compared with that of the DMDHEU-treated sample, indicated a possible hydrolysis of crosslinks by the cuene solution due to its strong alkalinity.

Although this invention has been described primarily with reference to the treatment of cotton fabrics and cotton fibers, those of skill in the art will understand that this novel treatment may also be used with other cellulose-containing fabrics and fibers. Examples of cellulose-containing fabrics and fibers include cotton, jute, flax, rayon, hemp, ramie, and blends containing any of the above fibers.

I claim:

1. A process for treating a fabric containing cellulose fibers, comprising the steps of:

(a) impregnating the fabric with one or more monomers, wherein each of said monomers is olefinically unsaturated and contains at least two carboxyl groups;

(b) polymerizing the monomers; and (c) esterifying cellulose from the fabric with the monomers, or with the polymerized monomer residues;

wherein said polymerizing step, said esterifying step, or both occur at a pH below about 2.

2. A process as recited in claim 1, where the cellulose fibers comprise cotton fibers.

3. A process as recited in claim 1, wherein said monomers comprise one or more of the following compounds or their anhydrides: maleic acid, itaconic acid, citraconic acid, trans-aconitic acid, or 3-butene-1,2,3-tricarboxylic acid.

4. A process as recited in claim 3, wherein the cellulose fibers comprise cotton fibers.

5. A process as recited in claim 4, wherein said monomers comprise maleic acid and itaconic acid, and wherein the molar ratio of maleic acid to itaconic acid is between 1:2 and 2:1.

6. A process as recited in claim 5, wherein an alkali metal persulfate is used as a free radical initiator to promote said polymerizing step.

7. A process as recited in claim 5, wherein sodium hypophosphite is used as a catalyst to promote said esterifying step.

8. A process as recited in claim 5, wherein said esterifying step occurs at a temperature between 160° C. and 190° C.

9. A process as recited in claim 5, wherein the molar ratio of maleic acid to itaconic acid is about 1:1.

10. A process as recited in claim 9, wherein said impregnating step is performed in an aqueous bath containing said monomers, and wherein said monomers comprise between 8.9% and 15.6% of the bath by weight.

11. A process as recited in claim 10, wherein:

(a) said monomers comprise about 12% of the bath by weight;

(b) an alkali metal persulfate is used as a free radical initiator to promote said polymerizing step; and (c) sodium hypophosphite is used as a catalyst to promote said esterifying step at a temperature between 160° C. and 190° C.

* * * * *